United States Patent [19]

Lara et al.

[11] 4,029,986

[45] June 14, 1977

[54] SPARK PLUG

[76] Inventors: Jose Hector Lara; Edward B. Williams, Jr., both of P. O. Box 876, Greenville, Tex. 75401

[22] Filed: May 20, 1976

[21] Appl. No.: 688,137

[52] U.S. Cl. ..... 313/123; 313/141

[51] Int. Cl.[2] ..... H01T 13/46

[58] Field of Search ..... 313/141, 142, 123

[56] References Cited

UNITED STATES PATENTS

| | | | |
|---|---|---|---|
| 1,090,815 | 3/1914 | Harter | 313/123 |
| 1,138,372 | 5/1915 | Gilbert | 313/123 |
| 1,352,592 | 9/1920 | Flatau | 313/141 X |
| 1,479,643 | 1/1924 | Blomster | 313/141 |
| 2,944,178 | 5/1960 | Schaub | 313/141 |

*Primary Examiner*—Rudolph V. Rolinec
*Assistant Examiner*—Darwin R. Hostetter
*Attorney, Agent, or Firm*—Fishburn, Gold & Litman

[57] ABSTRACT

An improved spark plug for use in internal combustion engines is effective to produce a plurality of sequential sparks. The spark plug has a metal shell with an insulator member in the metal shell and extending therefrom, as is conventional. The improvement comprises a first electrode which extends from one end of the insulator member and has a free end spaced from a first end of a second or carrier electrode end portion. A first set of a spark discharging surface and a spark landing surface is formed on the free end of the first electrode and on the first end of the carrier electrode end portion respectively. A third electrode extends from the metal shell and has a free end spaced from a second end of the second or carrier electrode end portion. A second set of a spark discharging surface and a spark landing surface is formed on the second end of the second or carrier electrode end portion and on the free end of the third electrode respectively.

4 Claims, 5 Drawing Figures

SPARK PLUG

The present invention relates to spark plugs and more particularly to a spark plug effective to produce a plurality of sequential sparks each being in the form of a hollow column.

Sequential sparks have been found to substantially improve the starting area of combustion and when each of the sparks is in the form of a hollow column, combustion is completed faster than normal combustion ignited by a single spark of a smaller diameter or area of spark. It has also been found that by forming the geometry of a spark discharging surface as a closed geometric figure and also by forming the geometry of a spark landing surface as a closed geometric figure that the discharge spark is forced to be of a larger size than that of a conventional spark plug. It has also been found that horse power of the internal combustion engine is substantially improved in the beginning portion of combustion when the time required to cmplete combustion is reduced, as by a plurality of sequential sparks. Even a minor improvement in the reduction of combustion time results in a substantial improvement in the economy and performance of an internal combustion engine. It has also been found that providing a bore extending transversely through each electrode portion having a spark landing surface thereon permits ignition of fuel adjacent the exterior surface of the respective electrode for even faster combustion.

The principal objects of the present invention are: to provide an improved spark plug operative to effect improved performance and economy of operation of internal combustion engines; to provide such a spark plug operative to produce a plurality of sequential sparks each being in the form of a hollow column to thereby effect improved and more complete burning or combustion of fuel in a combustion chamber; to provide such a spark plug operative to form each spark in the form of a hollow column thereby igniting fuel both inside and outside the spark column rather than only on the outside as with the rod-like spark as in conventional spark plugs thereby providing substantially greater surface area of spark and more uniform and faster burning of the fuel than fuel ignited by a spark of a conventional spark plug; to provide such a spark plug wherein a spark discharging surface and a spark landing surface of each set are in opposed relation with a bore extending transversely through the electrode having the spark landing surface thereon for escape of ignited fuel from within the hollow spark column; and to produce such a spark plug which is economical to manufacture, is durable in construction, has longer useful life than conventional spark plugs, is positive in operation, and is particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the improved spark plug for producing a plurality of sequential sparks.

Figure 1:
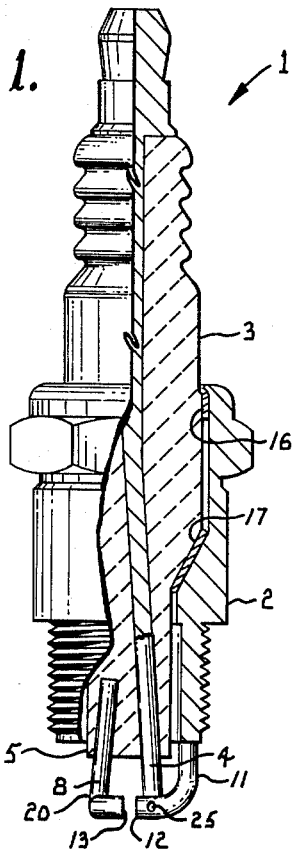
FIG. 1 is a side elevational view of a first side of a spark plug embodying features of the present invention and with portions broken away to better illustrate the component parts of the spark plug.
Figure 2:
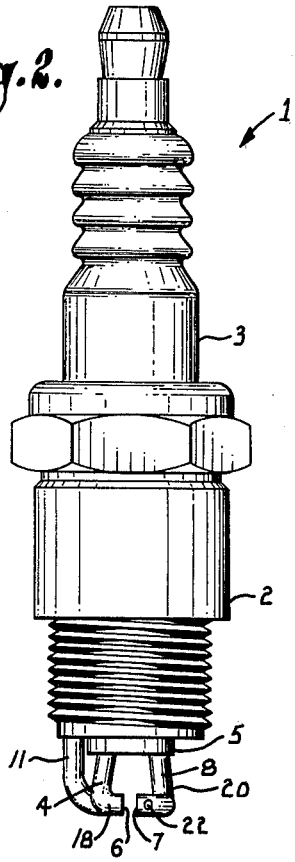
FIG. 2 is a side elevational view of a second side of the spark plug of the present invention
Figure 3:
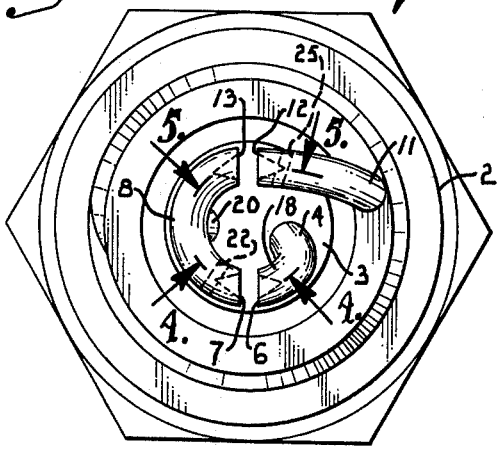
FIG. 3 is an enlarged end elevational view of the spark plug.
Figure 4:
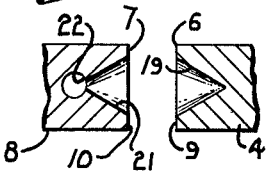
FIG. 4 is an enlarged fragmentary sectional view taken on line 4—4 of FIG. 3 and showing electrodes for effecting a first spark.
Figure 5:
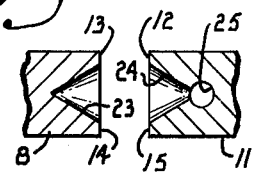
FIG. 5 is an enlarged fragmentary sectional view taken on line 5—5 of FIG. 3 and showing electrodes for effecting a second spark.

As required, detailed embodiments of the resent invention are disclosed herein. However, it is to be understood that the disclosed embodiments are merely exemplary of the invention which may be embodied in various forms. Therefore, the specific structural and functional details desclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally an improved spark plug for use in internal combustion engines (not shown). The improved spark plug 1 is effective to produce a plurality of sequential sparks. The spark plug 1 has a metal shell 2 with an insulator member 3 in the metal shell 2 and extending therefrom. The improvement comprises a first electrode 4 which extends from one end 5 of the insulator member 3 and has a free end 6 thereof spaced from a first end 7 of a second or carrier electrode end portion 8. A first set of a spark discharging surface 9 and a spark landing surface 10 is formed on the free end 6 of the first electrode 4 and on the first end 7 of the carrier electrode end portion 8 respectively. The spacing between the surfaces 9 and 10 is the first spark gap. A third electrode 11 extends from the metal shell 2 and has a free end 12 thereof spaced from a second end 13 of the second or carrier electrode end portion 8. A second set of a spark discharging surface 14 and a spark landing surface 15 is formed on the second end 13 of the second or carrier electrode end portion 8 and on the free end 12 of the third electrode 11 respectively. The spacing between the surfaces 14 and 15 is the second spark gap.

Each set of spark discharging portions are formed by adjacent and facing ridges in the form of a closed geometric figure. The respective ridges cooperate to form each spark in the form of a hollow column which is in the shape of the respective geometric figures. When the geometric figures are each circles of equal size, the spark discharging portions or surfaces and the spark landing portions or surfaces are annular and the spark is in the form of a hollow cylindrical column.

In the illustrated embodiment, the insulator member 3 is sealed within the metal shell 2 in a conventional manner, such as by using upper and lower metal ring seals 16 and 17 respectively positioned on respective shoulders of the insulator member 3. The first electrode 4 has an upper end portion thereof adapted to be connected to a source of timed electrical pulses, as by being adapted to receive a suitable spark plug wire (not shown) in any conventional manner.

The improvement of the present invention, as illustrated, includes forming the first electrode 4 as an elongated cylindrical rod having a major portion within the insulator member 3 and an end portion 18 extending from the one end 5 of the insulator member 3. The end portion 18 of the first electrode 4 is positioned to define an acute angle between the first electrode end portion 18 and a longitudinal axis of the insulator member 3. The first electrode end portion 18 has a free end portion which extends in an arcuate path from the one end 5 of the insulator member 3 and terminates in the free end 6 having the spark discharging surface 9 thereon. The spark discharging surface 9 is defined by a ridge in the form of a closed geometric figure.

The free end 6 of the first electrode end portion 18 includes means defining a recess 19 within and surrounded by the ridge defining the spark discharging surface 9. The recess 19 is illustrated as conical and the ridge defining the spark discharging surface 9 is illustrated as a circle The second or carrier electrode has a body portion 20 extending from the one end 5 of the insulator member 3. The carrier electrode body portion 20 is spaced from and insulated from the first electrode end portion 18 and is also positioned to define an acute angle between the body portion 20 and the longitudinal axis of the insulator member 3. The carrier electrode end portion 8 extends from the body portion 20 and the first portion 7 of the second electrode end portion 8 extends in an arcuate path from the body portion 20 and toward the free end 6 of the first electrode end portion 18.

The second end portion 13 of the second or carrier electrode end portion 8 extends in an arcuate path from the second electrode body portion 20 and toward the free end 12 of the third electrode 11. The first portion 7 and the second portion 13 of the carrier electrode end portion 8 cooperate to define an arcuate member extending from the body member or portion 20 and with the first and second portions 7 and 13 extending in opposite directions from the body portion 20.

The first end 7 of the carrier electrode end portion 8 includes means defining a recess 21 within and surrounded by the ridge defining the spark landing surface 10. The recess 21 is illustrated as conical and the ridge defining the spark landing surface 10 is illustrated as circular.

The first end 7 of the carrier electrode end portion 8 also includes means defining a bore 22 extending generally transversely through the first end portion 7 and intersecting and communicating with the recess 21 in the first portion 7 of the second electrode end portion 8. The bore 22 is positioned so that an axis of the bore 22 extends generally toward the longitudinal axis of the insulator member 3. The bore 22 permits escape of ignited fuel from within the hollow column of spark between the spark discharging surface 9 and the spark landing surface 10 on the free end 6 of the first electrode 4 and on the first portion 7 of the carrier electrode end portion 8 respectively of the first spark gap.

The second end 13 of the carrier electrode end portion 8 includes means in the form of a ridge also in the form of a closed geometric figure thereby defining the spark discharging surface 14. The second end 13 of the carrier electrode end portion 8 includes means defining a recess 23 within and surrounded by the ridge defining the spark discharging surface 14. The recess 23 is illustrated as conical and the ridge is illustrated as circular.

The third electrode free end portion 12 extends in an arcuate path from the metal shell 2 and terminates in the spark landing surface 15 and the third electrode free end portion 12 extends toward the end of the second portion 13 of the second or carrier electrode end portion 8. The spark landing surface 15 is defined by a ridge in the form of a closed geometric figure.

The free end portion 12 of the third electrode 11 includes means defining a recess 24 within and surrounded by the ridge defining the spark landing surface 15. The recess 24 is illustrated as conical and the ridge defining the spark landing surface 15 is illustrated as circular.

The free end 12 of the third electrode 11 also includes means defining a bore 25 extending transversely through the free end portion 12 and intersecting and communicating with the recess 24 in the free end 12 of the third electrode 11. The bore 25 is positioned so that an axis of the bore 25 extends generally toward the longitudinal axis of the insulator member 3. The bore 25 permits escape of ignited fuel from within the hollow column of spark between the spark discharging surface 14 and the spark landing surface 15 on the second end 13 of the carrier electrode end portion 8 and the free end 12 of the third electrode 11 respectively of the second gap.

In the illustrated structure, the arcuate arrangement of the electrode end portions are such that the spark gaps are spaced apart and substantially diametrically opposite. Also the electrodes provide such spacing and are still within the diameter of the hole in which the spark plug is to be mounted.

In operation of an improved spark plug constructed as illustrated and described, electrical current flows through the first electrode 4 and to the free end 6 thereof. A first spark moves from the spark discharging surface 9 on the first electrode free end 6 and toward the spark landing surface 10 on the first end 7 of the carrier electrode end portion 8. The first spark is in the form of a hollow column with fuel ignited both within and outside the column of spark. Ignited fuel within the hollow column of spark then flows outwardly through the recess 21 and the bore 22 of the first end 7 of the carrier electrode end portion 8 and is directed both toward the interior and exterior of the spark plug 1. Electrical current then flows through the carrier electrode end portion 8 and to the second portion 13 of the carrier electrode end portion 8. A second spark then moves from the spark discharging surface 14 on the second portion 13 of the carrier electrode end portion 8 and toward the spark landing surface 15 on the free end 12 of the third electrode 11. The second spark is also in the form of a hollow column with the fuel ignited both inside and outside the column of spark. Ignited fuel within the hollow column then flows outwardly through the recess 24 and the bore 25 in the free end portion 12 of the third electrode 11 and is directed toward both the interior and exterior of the spark plug 1.

While electrode portions for effecting two sparks have been shown, it is to be understood that any desired number of sparks may be produced by positioning a selected plurality of carrier electrodes between the first electrode 4 and the third electrode 11 and with the carrier electrode end portions aligned to form a plurality of sets of spark discharging and landing portions or surfaces.

It is to be understood that while we have illustrated and described one form of our invention, it is not to be limited to the specific form or arrangement of parts herein described and shown.

What we claim and desire to secure Letters Patent is:

1. In a spark plug having an insulator and a metal shell:

a. a first electrode for connection to a source of timed electrical pulses, said first electrode having a free end with a recess therein, said recess having a depth of less than a transverse dimension of said first electrode;

b. a second electrode insulated from said first electrode and having a first free end extending toward and aligned with said free end of said first electrode and spaced therefrom to define a first spark gap therebetween, said second electrode first free end having a recess therein with a depth of less than a transverse dimension of said second electrode first free end, said second electrode first free end having a bore extending transversely therethrough and intersecting and communicating with said recess in said second electrode first free end, said second electrode having a second free end extending therefrom and in opposed relation to said first free end of said second electrode, said second electrode second free end having a recess therein with a depth of less than a transverse dimension of said second electrode second free end; and c. a third electrode having a ground connection with a metal shell of a spark plug, said third electrode having a free end extending toward and aligned with said second end of said second electrode and spaced therefrom to define a second spark gap therebetween, said third electrode free end having a recess therein with a depth of less than a transverse dimension of said third electrode free end, said third electrode free end having a bore extending transversely therethrough and intersecting and communicating with said recess in said third electrode free end.

2. In a spark plug having a metal shell having a central passage therethrough and an insulator member positioned in said metal shell central passage and having opposite ends;

a. an elongated first electrode in a spark plug insulator member and having a free end portion thereof spaced from one end of the insulator member, said first electrode free end portion having a recess therein, said recess having a depth of less than a transverse dimension of said first electrode free end portion, said first electrode having an other end for connection to a source of timed electrical pulses;

b. a second electrode in the insulator member and having an end portion with a first portion thereof in spaced and facing relation with said free end portion of said first electrode, said first portion of said second electrode end portion having a recess therein with a depth of less than a transverse dimension of said second electrode end portion, said first portion of said second electrode end portion having a bore extending transversely through said first portion of said second electrode end portion and intersecting and communicating with said recess in said first portion of said second electrode end portion, said second electrode end portion having a second portion with a recess therein and having a depth of less than a transverse dimension of said second portion of said second electrode end portion;

c. means on said first electrode free end portion and on said first portion of said second electrode end portion defining a spark discharging portion on said first electrode free end portion and a spark landing portion on said first portion of said second electrode end portion thereby defining a first spark gap;

d. a third electrode extending from a spark plug metal shell and having a free end portion thereof in spaced and facing relation with said second portion of said second electrode end portion, said third electrode free portion having a recess therein with a depth of less than a transverse dimension of said third electrode free end portion, said third electrode free end portion having a bore extending transversely through said third electrode free end portion and intersecting and communicating with said recess in said third electrode free end portion; and e. means on said second portion of said second electrode end portion and on said third electrode free end portion defining a spark discharging portion on said second portion of said second electrode end portion and a spark landing portion on said third electrode free end portion thereby defining a second spark gap.

3. In a spark plug as set forth in claim 2 wherein:

a. said first electrode free end portion extends in an arcuate path from the one end of the spark plug insulator member;

b. said second electrode includes a body portion extending from the spark plug insulator member;

c. said first portion of said second electrode end portion extends in an arcuate path from said second electrode body portion and toward said first electrode free end portion;

d. said second portion of said second electrode end portion extends in an arcuate path from said second electrode body portion and toward said third electrode free end portion; and e. said third electrode free end portion extends in an arcuate path from the spark plug metal shell.

4. In a spark plug as set forth in claim 2 wherein:

a. the insulator member has a longitudinal axis;

b. a portion of said first electrode adjacent said free end portion thereof is positioned to define an acute angle between the portion of said first electrode adjacent said first electrode free end portion and the longitudinal axis of the insulator member; and c. said second electrode includes a body portion extending from said second electrode end portion and positioned to define an acute angle between said second electrode body portion and the longitudinal axis of the insulator member.

* * * * *